US006588957B2

(12) United States Patent
Ohba

(10) Patent No.: US 6,588,957 B2
(45) Date of Patent: Jul. 8, 2003

(54) CARTRIDGE TYPE STICK-SHAPED COSMETIC MATERIAL FEEDING CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/223,687

(22) Filed: Aug. 20, 2002

(65) Prior Publication Data

US 2003/0053843 A1 Mar. 20, 2003

(30) Foreign Application Priority Data

Aug. 21, 2001 (JP) ..... 2001-250682

(51) Int. Cl.[7] ..... B43K 21/08
(52) U.S. Cl. ..... 401/75; 401/68; 401/92
(58) Field of Search ..... 401/92, 88–86, 401/80–77, 75–73, 68, 55

(56) References Cited

U.S. PATENT DOCUMENTS 5,813,421 A * 9/1998 Wang ..... 132/318
6,048,122 A * 4/2000 Ohba ..... 401/55
6,200,047 B1 * 3/2001 Holloway ..... 401/75
6,309,121 B1 * 10/2001 Ohba ..... 401/78
6,331,084 B1 * 12/2001 Ohba ..... 401/68
6,334,729 B1 * 1/2002 Ohba ..... 401/68
6,499,897 B2 * 12/2002 Yamamoto ..... 401/68

FOREIGN PATENT DOCUMENTS

JP 2000-135116 5/2000

* cited by examiner

*Primary Examiner*—Gregory Huson
*Assistant Examiner*—Huyen Le
(74) *Attorney, Agent, or Firm*—Rabin & Berdo, PC

(57) ABSTRACT

A cartridge type stick-shaped cosmetic material feeding container 1 comprises a cartridge 2 and a container body 3, and the cartridge 2 rotatably connects a base cylinder 20 and a front cylinder 10 having an opening hole 11 through which a stick-shaped cosmetic material A advances and retreats. The stick-shaped cosmetic material A is retained by claws 32 at a front end of a core chuck member 30 inserted and an O-ring 4 is wound to an outer circumference of the base cylinder 20. Due to a feeding mechanism in the cartridge 2, the stick-shaped cosmetic material A retained by the core chuck member 30 advances and retreats along the front cylinder 10 with rotations of the front cylinder 10 and the base cylinder 20. The feeding mechanism of the cartridge 2 inserted in the container body 3 functions when the base cylinder 20 and the container body 3 synchronously rotate by frictional resistance of an inner circumference of the container body and the O-ring 4 wound to the base cylinder 20. Further, when a rotary load greater than frictional resistance of the O-ring 4 is applied at the feeding limit, the cartridge 2 and the container body 3 begin to make relative rotations so that no further overload greater than the rotary load is applied to the feeding mechanism.

4 Claims, 8 Drawing Sheets

CARTRIDGE TYPE STICK-SHAPED COSMETIC MATERIAL FEEDING CONTAINER

BACKGROUND OF THE INVENTION

1. Field of the Invention

The present invention relates to a cartridge type stick-shaped cosmetic material feeding container.

2. Description of the Related Art

A cartridge type stick-shaped cosmetic material feeding container comprises a cartridge in which a stick-shaped cosmetic material is equipped and a container body which is rotatably connected with the cartridge. The cartridge type stick-shaped cosmetic material feeding container also feeds out the stick-shaped cosmetic material from the cartridge and houses the stick-shaped cosmetic material therein due to relative rotations of the cartridge and the container body.

However, a further rotary load is applied at an uppermost limit and a lowermost limit of the stick-shaped cosmetic material fed out, the rotary load has an influence on a retaining section of the stick-shaped cosmetic material, so that there is a possibility of being a cause of breaking or chipping of the stick-shaped cosmetic material. Particularly in the case that a stick-shaped cosmetic material having a thin diameter is furnished, it is necessary to have a function of protecting against the rotary load applied at the uppermost limit and the lowermost limit.

JP-A2000-135116 has been disclosed in a Japanese patent gazette as a conventional cartridge type stick-shaped cosmetic material feeding container.

In this feeding container, a leaf spring is installed in a container body, and it is possible to synchronously rotate a cylindrical body and the container body by bringing the cylindrical body which constitutes a cartridge in contact with the container body by the leaf spring in the container body.

Therefore, due to the leaf spring in the container body, it is possible to synchronously rotate the container body and the cylindrical body which constitutes the cartridge, and also the cylindrical body can clutch with respect to the leaf spring when a rotary load is applied at the uppermost limit and the lowermost limit. However, operational expenses for installing the leaf spring in the container body become a cause of increasing the costs of the container body together with a unit cost of the leaf spring, whereby the valuable advantage of capable of providing the container body at a cheap price is spoiled by costs of the leaf spring and operational expenses for installing the leaf spring.

SUMMARY OF THE INVENTION

An object of the present invention is to take measures to secure the stick-shaped cosmetic material by providing a function of not influencing a core chuck member which is protective against a further rotary load applied at the uppermost limit and the lowermost limit of a cartridge and to provide the container body at a cheap price.

A cartridge type stick-shaped cosmetic material feeding container according to the present invention comprises:

a cartridge in which a stick-shaped cosmetic material is stored; and a container body which the cartridge can freely attach to and detach from, wherein the stick-shaped cosmetic material in the cartridge is caused to advance and retreat due to relative rotations of the container body and the cartridge attached to the container body; the cartridge is constituted by a front cylinder and a base cylinder which is coaxially and rotatably connected with the front cylinder; a feeding mechanism which moves, due to relative rotations of the front cylinder and the base cylinder, in an axial direction a core chuck member for retaining the stick-shaped cosmetic material is provided in the cartridge; an elastic body which comes into contact with an inner circumference of the container body is wound around an outer circumference of the base cylinder at a part where the base cylinder of the cartridge is attached to the container body; and due to frictional resistance of the elastic body, the container body and the base cylinder are synchronously rotated and also the container body and the base cylinder are allowed to make relative clutch rotations at a travelling limit of the core chuck member.

BRIEF DESCRIPTION OF THE DRAWINGS

FIG. 1(A) shows the cartridge and FIG. 1(B) shows the container body.

FIG. 3(A) shows a front cylinder, FIG. 3(B) a base cylinder, FIG. 3(C) a core chuck member, and FIG. 3(D) a stopper member, respectively.

FIG. 5(A) shows a cartridge and FIG. 5(B) shows a container body, respectively.

DESCRIPTION OF THE PREFERRED EMBODIMENTS

A first embodiment of the present invention will be shown in FIGS. 1 through 4.

Figure 1:
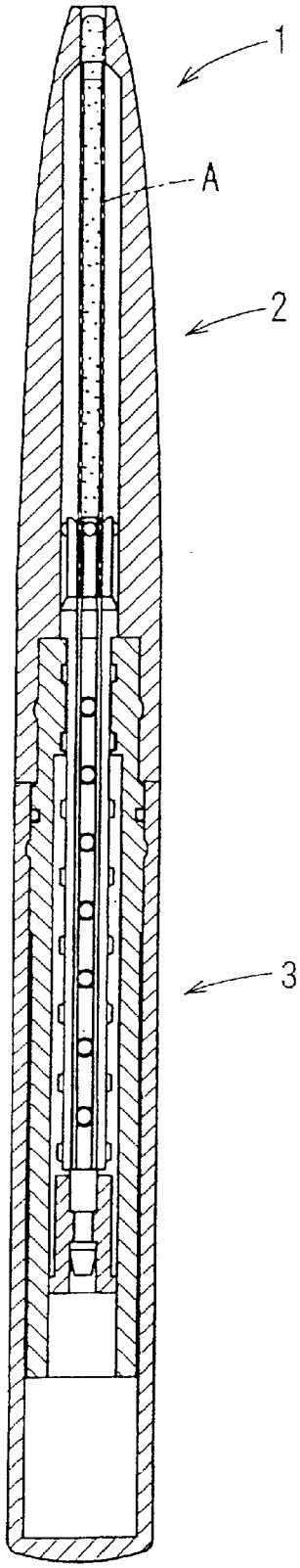
FIG. 1 is a partially longitudinal section showing a cartridge type stick-shaped cosmetic material feeding container according to a first embodiment of the present invention.

A cartridge type stick-shaped cosmetic material feeding container 1 according to the present invention which is shown in FIG. 1 is constituted by a cartridge 2 shown in FIG. 2(A) and a container body 3 shown in FIG. 2(B) in which the cartridge is contained.

Figure 3:
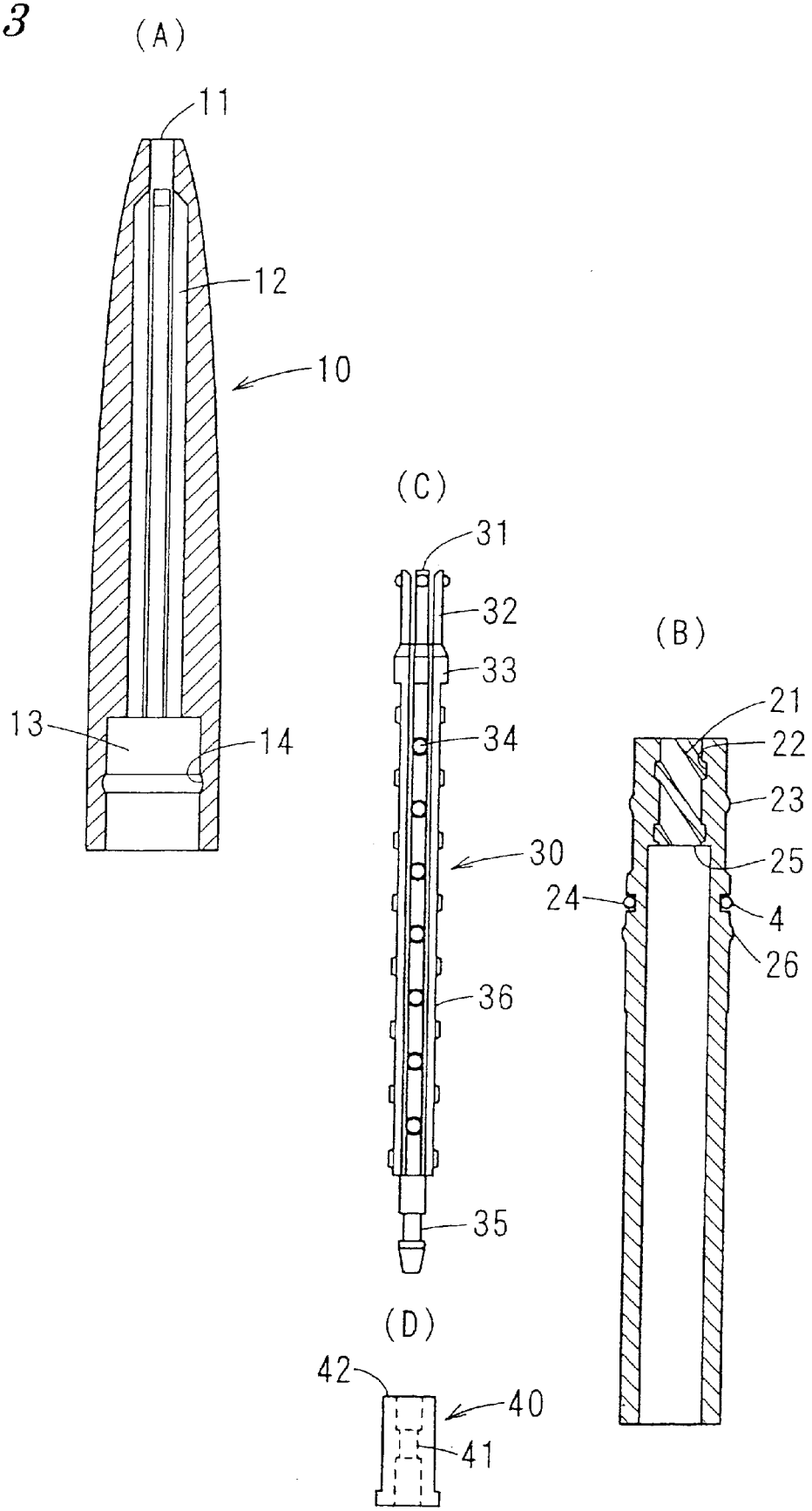
FIG. 3 is a partially longitudinal section showing each member of the cartridge type stick-shaped cosmetic material feeding container.

FIG. 3 shows each member of the cartridge 2 which is used in the present invention. FIG. 3(A) shows a front cylinder 10, FIG. 3(B) shows a base cylinder 20 which is rotatably connected with the front cylinder 10, FIG. 3(C) shows a core chuck member 30 to be inserted in the front cylinder 10 and the base cylinder 20, and FIG. 3(D) shows a stopper member 40 which is fixed to a lower end of the core chuck member 30 and defines the uppermost limit, respectively.

Figure 4:
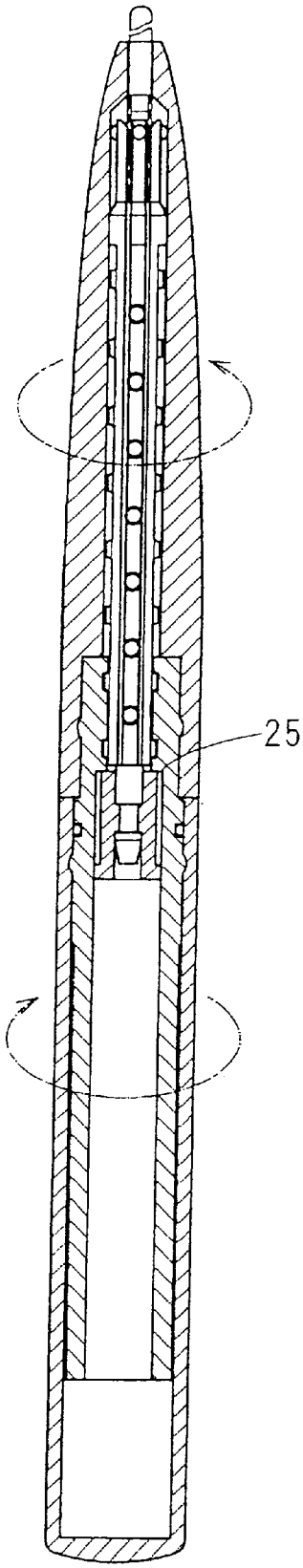
FIG. 4 is a partially longitudinal section showing a state which the cartridge type stick-shaped cosmetic material feeding container of FIG. 1 is fed out to an uppermost limit and a further rotary load is applied.

FIG. 4 shows a state which the cartridge 2 and the container body 3 of the cartridge type stick-shaped cosmetic material feeding container 1 are fed out to the uppermost limit and a further rotary load is applied.

As shown in FIG. 2(A), a front end section of the base cylinder 20 is inserted into the front cylinder 10, and the base cylinder 20 and the front cylinder 10 are rotatably connected to each other. The core chuck member 30 is installed in these front cylinder 10 and base cylinder 20 and a stick-shaped cosmetic material retaining section 31 is installed at a front end of the core chuck member 30. The stopper member 40 is fixed to a rear end of the core chuck member 30.

Further, the cartridge 2 is constituted by a container body housed section 2*b* which is housed in the container body 3 and a pinching section 2*a* which rotates relatively to the container body 3.

In the cartridge 2 according to the first embodiment, the pinching section 2*a* is the front cylinder 10 and the container body housed section 2*b* is the base cylinder 20.

A further detailed description of the cartridge 2 will be given.

As shown in FIG. 3(A), the front cylinder 10 has an opening hole 11 at its front end and four pieces of slide grooves 12 are provided in a through hole inside the front cylinder 10. A spiral section 21 provided at a front section of the base cylinder 20 as shown in FIG. 3(B) is inserted into a cavity section 13 which is provided at a rear part of the front cylinder 10 and is connected with the through hole. At this time, because a fit-in convex section 23 provided at an upper outer circumference of the base cylinder 20 fits in an annular concave section 14 which is formed at an inner circumference of the cavity section 13 of the front cylinder 10, the front cylinder 10 and the base cylinder 20 are rotatably connected to each other without coming off.

Further, an O-ring groove 24 located below the fit-in convex section 23 is provided at an outer circumference of the base cylinder 20. An O-ring 4 is attached to the O-ring groove 24. Further, at a location below the O-ring groove 24, there is provided a projection 26 which fits in the container body 3 in such a manner that the projection 26 can freely attach to and detach from the container body 3.

The core chuck member 30 described above is shown in FIG. 3(C), and the stick-shaped cosmetic material retaining section 31 provided at a front end of the core chuck member 30 is constituted by four pieces of claws 32 for retaining a stick-shaped cosmetic material A. These claws 32 are installed at positions corresponding to the slide grooves 12 of the front cylinder 10, respectively. Linear projections 33 are installed at lower parts of the claws 32, respectively, in such a manner that the linear projections 33 are protruded outward. The linear projections 33 are engaged with the slide grooves 12 of the front cylinder 10 and slide, thereby constituting a rotation regulating mechanism for preventing relative rotations of the core chuck member 30 and the front cylinder 10.

Further, a stick-shaped axis section 36 which coaxially extends from a lower end of the stick-shaped cosmetic material retaining section 31 is provided at the core chuck member 30. On a surface of the stick-shaped axis section 36, projections 34 are arranged at a regular interval on the same lines as the respective lines of the four pieces of claws 32. And, these projections 34 are spirally engaged with a spiral groove 22 of the spiral section 21 installed at an upper inner circumference of the base cylinder 20. Thus, the stick-shaped axis section 36 rises or descends under the guidance of the spiral section 21 with the relative rotations of the core chuck member 30 and the base cylinder 20, thereby constituting a spiral engagement mechanism.

As shown in FIG. 3(D), an engagement groove 35 is provided at a lower end of the stick-shaped axis section 36 and an engagement section 41 of the stopper member 40 fits in the engagement groove 35, whereby the stopper member 40 is fixed to the core chuck member 30.

Figure 2:
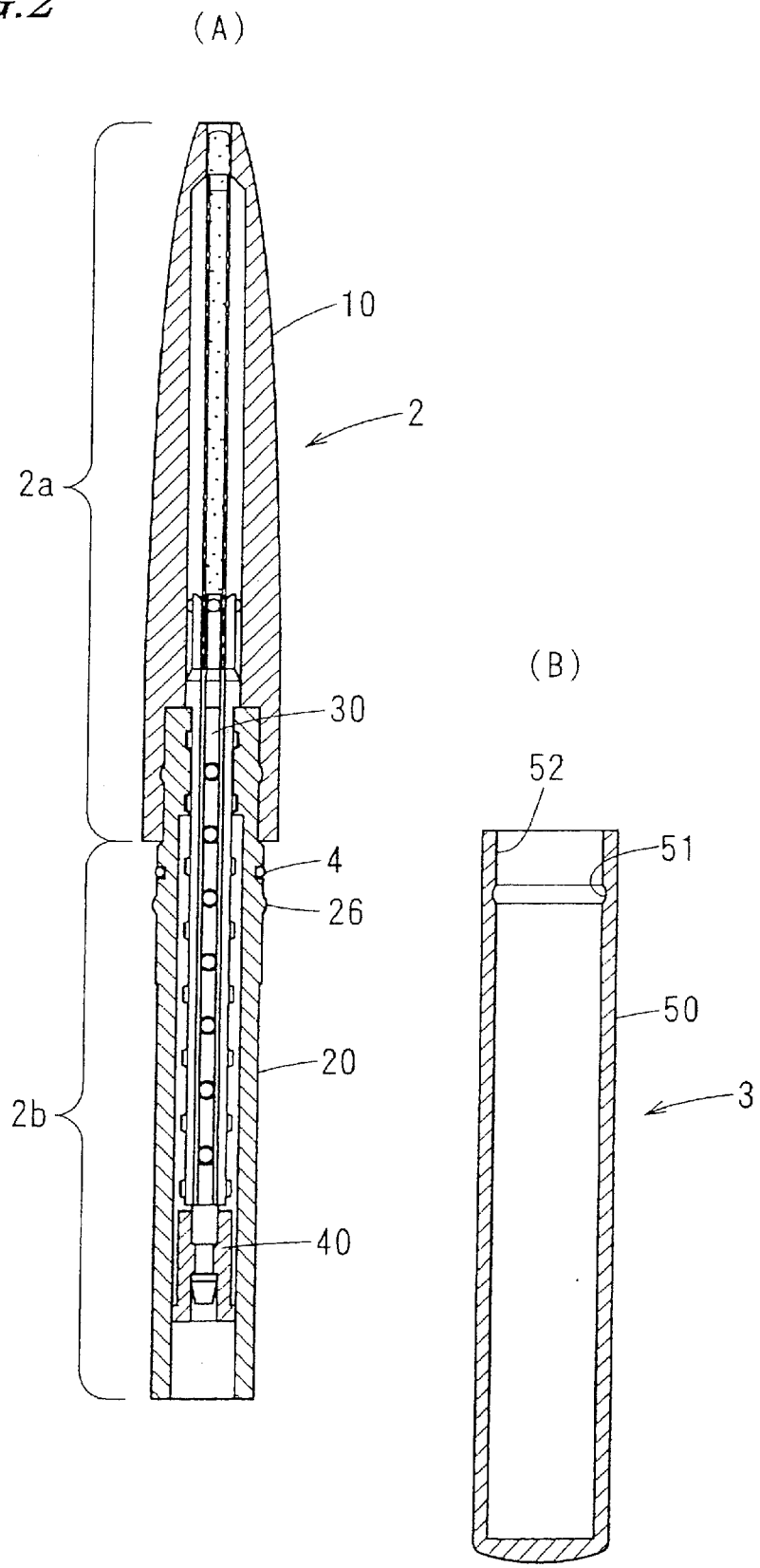
FIG. 2 is a partially longitudinal section showing a state which a cartridge is removed from a container body of the cartridge type stick-shaped cosmetic material feeding container of FIG. 1.

When the pinching section 2*a* and the container body housed section 2*b* of the cartridge 2 assembled as shown in FIG. 2 are relatively rotated, due to a feeding mechanism which is constituted by the rotation regulating mechanism between the front cylinder 10 and the core chuck member 30 and the spiral engagement mechanism between the core chuck member 30 and the base cylinder 20, the core chuck member 30 is fed out in an axial direction and the stick-shaped cosmetic material A begins to project through the opening hole 11 provided at a front end of the front cylinder 10.

Further, if the pinching section 2*a* and the container body housed section 2*b* are rotated reversely to the above, the core chuck member 30 will retreat and the stick-shaped cosmetic material A will be dragged into the front cylinder 10.

When the cartridge 2 is inserted into a body cylinder 50 which is the container body 3 shown in FIG. 2(B), the projection 26 provided at an outer circumference of the base cylinder 20 fits in a fit-in concave section 51 in the body cylinder 50. At this time, the O-ring 4 comes into contact with an O-ring contact surface 52 provided at an inner circumference of the body cylinder 50 while pressing the O-ring contact surface 52.

At this time, unless great drawing force to draw the cartridge 2 from the container body 3 is applied, the container body 3 and the cartridge 2 are kept connected to each other. When the pinching section 2*a* of the cartridge 2 and the body cylinder 50 of the container body 3 are relatively rotated in such a state, the base cylinder 20 rotates synchronously with the body cylinder 50 of the container body 3 due to frictional resistance of the O-ring 4. Therefore, the feeding mechanism composed of the spiral engagement mechanism and the rotation regulating mechanism operates and the stick-shaped cosmetic material A begins to project through the opening hole 11 provided at a front end of the front cylinder 10 of the cartridge 2.

FIG. 4 shows a state which the cartridge 2 and the container body 3 are rotated up to the feeding uppermost limit. In this state, a front end section 42 of the stopper member 40 which is fixed to a lower end of the core chuck member 30 comes into contact with a spiral section lower end surface 25 of the base cylinder 20, whereby a further rise of the core chuck member 30 is stopped.

When the cartridge 2 and the container body 3 are further rotated in a feeding direction by applying a rotary load in such a state, the O-ring contact surface 52 of the container body 3 begins to slide with respect to the O-ring 4 which is wound to an outer circumference of the base cylinder 20 and has played a role of synchronously rotating the base cylinder 20 and the container body 3 as a frictional resistance member between the outer circumference of the base cylinder 20 and an inner circumferential surface of the container body 3. Due to a load exceeding the resistance limitation, the base cylinder 20 which constitutes the cartridge 2 rotates with respect to the container body 3.

In the present invention, such a sliding rotation is called as a clutch rotation, and due to the clutch rotation, it is possible to prevent the feeding mechanism in the cartridge 2 from being damaged which may occur resulting from an overload. It is also possible to prevent the stick-shaped cosmetic material A from breaking or chipping which may occur due to a load applied to the claws 32 of the stick-shaped cosmetic material retaining section 31.

In the first embodiment, the O-ring 4 is wound to the base cylinder 20 and the feeding operation and the clutch rotation of the cartridge 2 are carried out by utilizing the frictional force. However, the first embodiment is not restricted to the O-ring 4. It will be sufficient if an elastic body, such as elastomer or silicone rubber, which generates prescribed frictional resistance between the base cylinder 20 of the cartridge 2 and an inner circumference of the container body 3 is used.

When the pinching section 2*a* of the cartridge 2 and the container body 3 are rotated in a direction of withdrawal oppositely to the above, the clutch rotations are stopped and the stick-shaped cosmetic material A is drawn into the cartridge 2 due to the mechanisms including elastic friction of the O-ring 4. Further, when a rotary load is further applied at the feeding lowermost limit, the base cylinder 20 begins to make a clutch rotation with respect to the container body 3 for the same reason as the above.

Incidentally, by installing the O-ring 4 which is an elastic body on the cartridge side, it is possible to provide the container body 3 at a low price.

Figure 5:
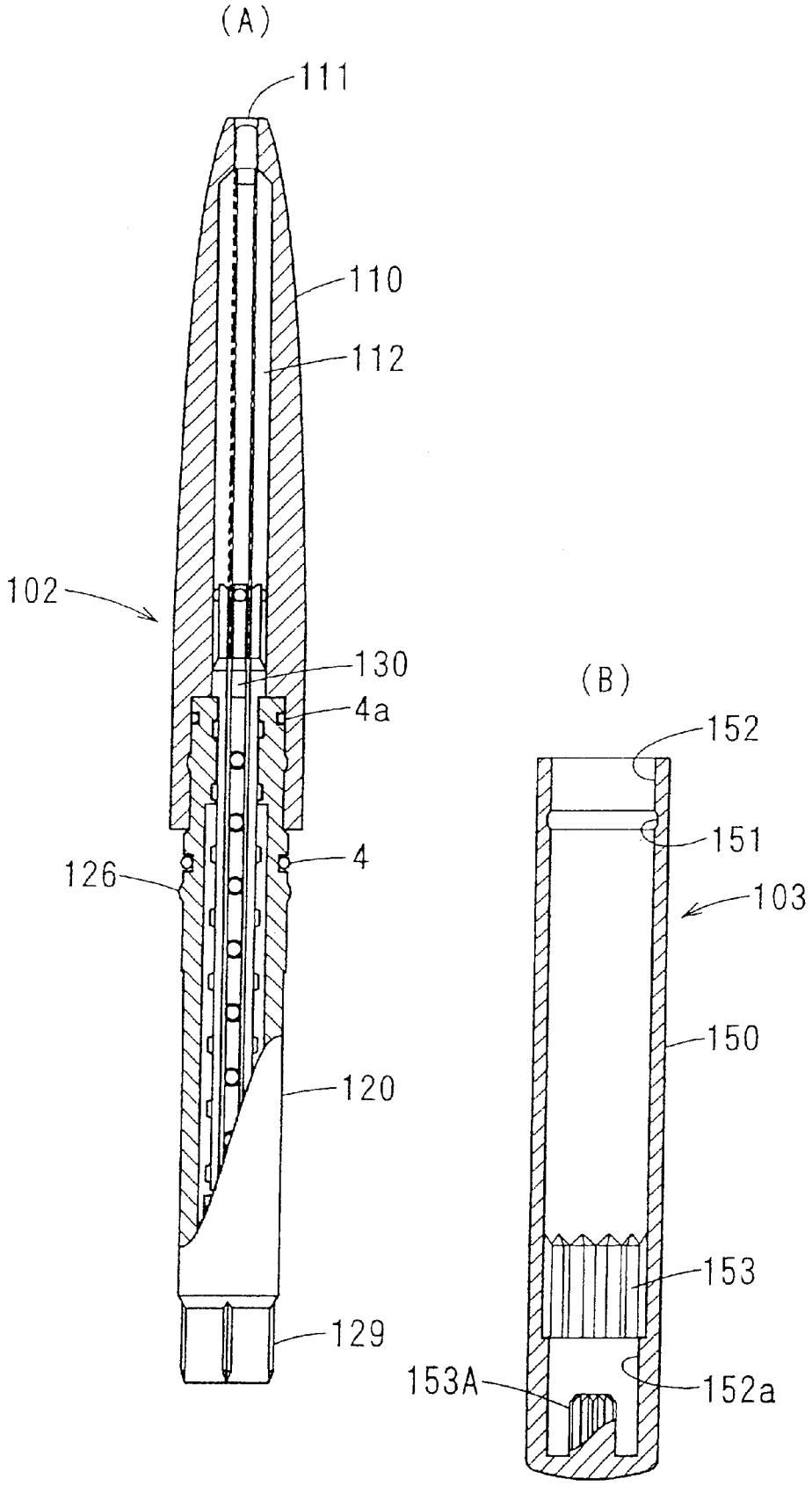
FIG. 5 is a partially longitudinal section showing a cartridge type stick-shaped cosmetic material feeding container according to a second embodiment of the present invention.
Figure 6:
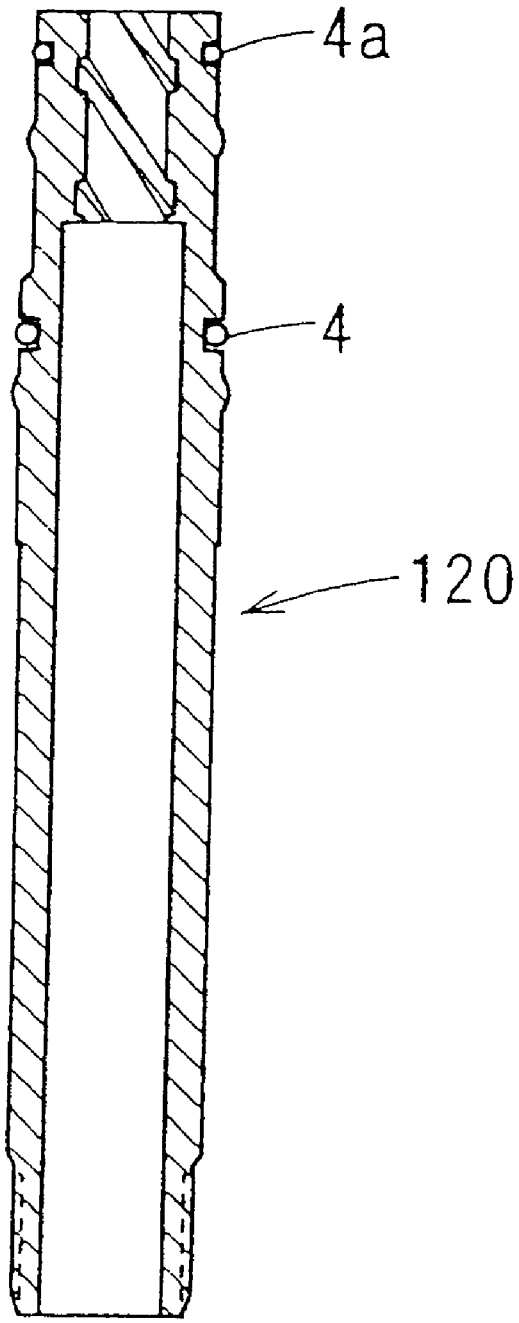
FIG. 6 is a partially longitudinal section showing a base cylinder to be used in the cartridge type stick-shaped cosmetic material feeding container of FIG. 5.
Figure 7:
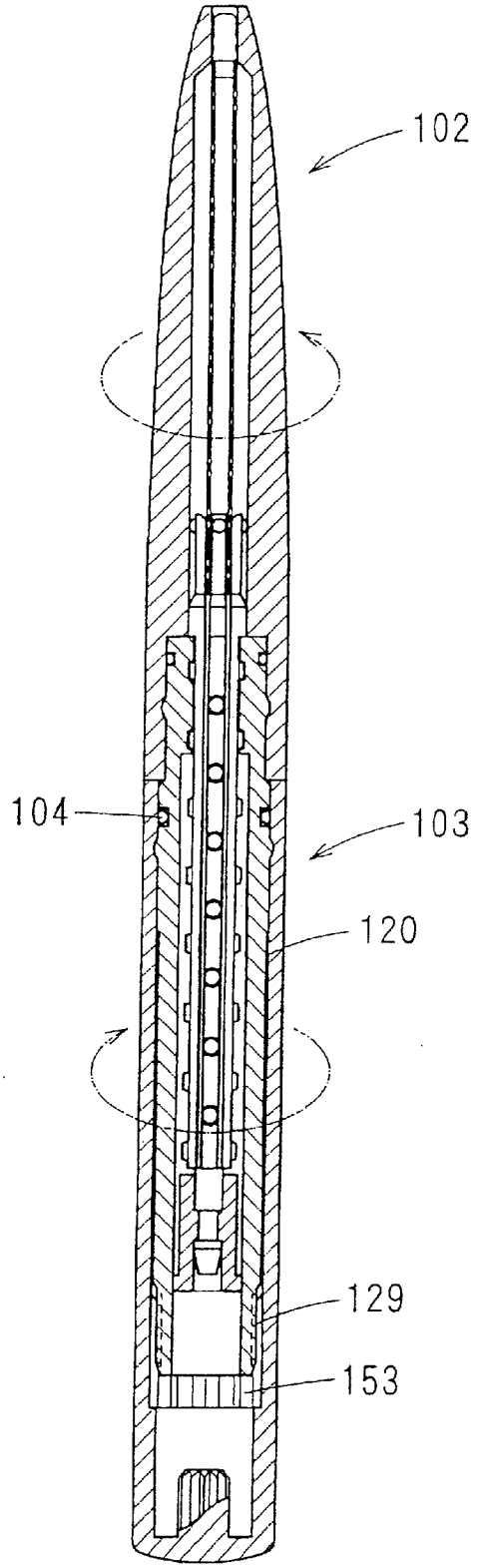
FIG. 7 is a partially longitudinal section showing a state of the cartridge type stick-shaped cosmetic material feeding container of FIG. 5 at the time of rotation.

FIGS. 5 through 7 show a second embodiment of the present invention in which a cartridge 102 is constituted by the same mechanism as that of the cartridge 2 according to the first embodiment.

In the second embodiment, it is possible to install contact ribs 129 at a rear part of a base cylinder 120.

And, as it is clearly shown in FIG. 5(B), a roulette section 153 which comes into contact with the contact ribs 129 of the base cylinder 120 is formed at an inner circumference of a body cylinder 150 which is a container body 103 to house the cartridge 102.

Further, because the container body 103 is able to also house a cartridge which will be described later and has completely different constitution, a roulette boss section 153A is installed at a bottom part of the container body 103 in a standing position.

A cartridge type stick-shaped cosmetic material feeding container 101 according to the second embodiment differs from the cartridge type stick-shaped cosmetic material feeding container 1 according to the first embodiment in the following points.

The cartridge 2 according to the first embodiment is constituted such that the front cylinder 10 and the base cylinder 20 are rotatably connected as shown in FIG. 2(A) and the base cylinder 20 is entirely housed in the container body 3 of FIG. 2(B).

In this case, it is only natural that there is a gap between the front cylinder 10 and the base cylinder 20 of the cartridge 2 because of the rotations. Thus, the front cylinder 10 and the base cylinder 20 are slightly inclined or become unsteady.

Further, in the rotation shown in FIG. 4, the base cylinder 20 and the container body 3 make relative rotations via the O-ring 4 at the time of the clutch rotation caused by a rotary load which exceeds the feeding uppermost limit. However, because no special noises arise and no great rotary loads are applied at this time, it is not so easy for a user to know that the core chuck member 30 has already reached the uppermost limit or the lowermost limit.

Thus, in the cartridge type stick-shaped cosmetic material feeding container, another O-ring 4*a* in addition to the O-ring 4 is wound to the base cylinder 120 as shown in FIG. 6.

As shown in FIG. 5(A), the O-ring 4*a* is used as a cartridge having slide resistance between a front cylinder 110 and the base cylinder 120. The O-ring 4*a* minimizes the unsteadiness of the front cylinder 110 and the base cylinder 120 and prevents a core chuck member 130 from being pushed back in a direction of retreat, thereby creating a classy atmosphere in the cartridge.

The O-ring 4 to be wound to a lower part of the base cylinder 120 is used as means for synchronously rotating the base cylinder 120 and the container body 103 by frictional resistance of the O-ring 4 when the cartridge 102 fits in the container body 103. As a matter of course, it is set such that the frictional resistance of the O-ring 4 is stronger than slide resistance of the O-ring 4*a*. Otherwise, the base cylinder 120 does not rotate with respect to the front cylinder 110, and the base cylinder 120 and the container body 103 relatively rotate. In other words, racing brings about and the feeding mechanism of the cartridge does not function.

Next, the contact ribs 129 are installed at the base cylinder 120 of the cartridge 102 as described above and the roulette section 153 which comes into contact with the contact ribs 129 are installed in the container body 103.

The container body 103 and the cartridge 102 which fits in the container body 103 synchronously rotate due to the frictional resistance of the O-ring 4. When the cartridge 102 and the container body 103 begin to relatively rotate at the feeding uppermost limit due to a rotary load, the roulette section 153 of the container body 103 and the contact ribs 129 relatively rotate, thereby generating a clutch noise. Therefore, a user can confirm that the cartridge 102 has already been at the feeding uppermost limit. The clutch noise does not increase due to the O-ring 4 which comes into contact with the container body 103 and the user can feel the clutch noise by vibrations.

Further, the roulette section 153 of the container body 103 may be provided with several engagement ribs as an engagement contact section.

Incidentally, it is set such that contact friction of the roulette section 153 and the contact ribs 129 is smaller than frictional resistance of the O-ring 4. Thus, it is arranged such that an overload does not transfer from the container body 103 to the base cylinder 120 at the time of clutch rotation.

In the cartridge type stick-shaped cosmetic material feeding container 101 according to the second embodiment, the O-ring 4*a*, namely, a first elastic body is wound to the base cylinder 120 of the cartridge 102. By using the first elastic body as a cartridge having slide resistance between the first elastic body and the front cylinder 110, a stick-shaped cosmetic material contained in the core chuck member 130 is prevented from projecting or breaking which may occur due to transportation or vibrations. Also, the core chuck member 130 is prevented from being pushed back in a direction of retreat and the unsteadiness of the front cylinder 110 and the base cylinder 120 is minimized. Thus, the first elastic body is such an important O-ring. Further, a second elastic body which is the O-ring 4 to be provided between the container body 103 and the base cylinder 120 of the cartridge 102 has frictional resistance between the container body 103 and the base cylinder 120 when the base cylinder 120 fits in the container body 103, and the second elastic body is used as means for synchronously rotating the container body 103 and the base cylinder 120. Thus, it is designed such that frictional resistance of the second elastic body is greater than slide resistance of the first elastic body.

Figure 8:
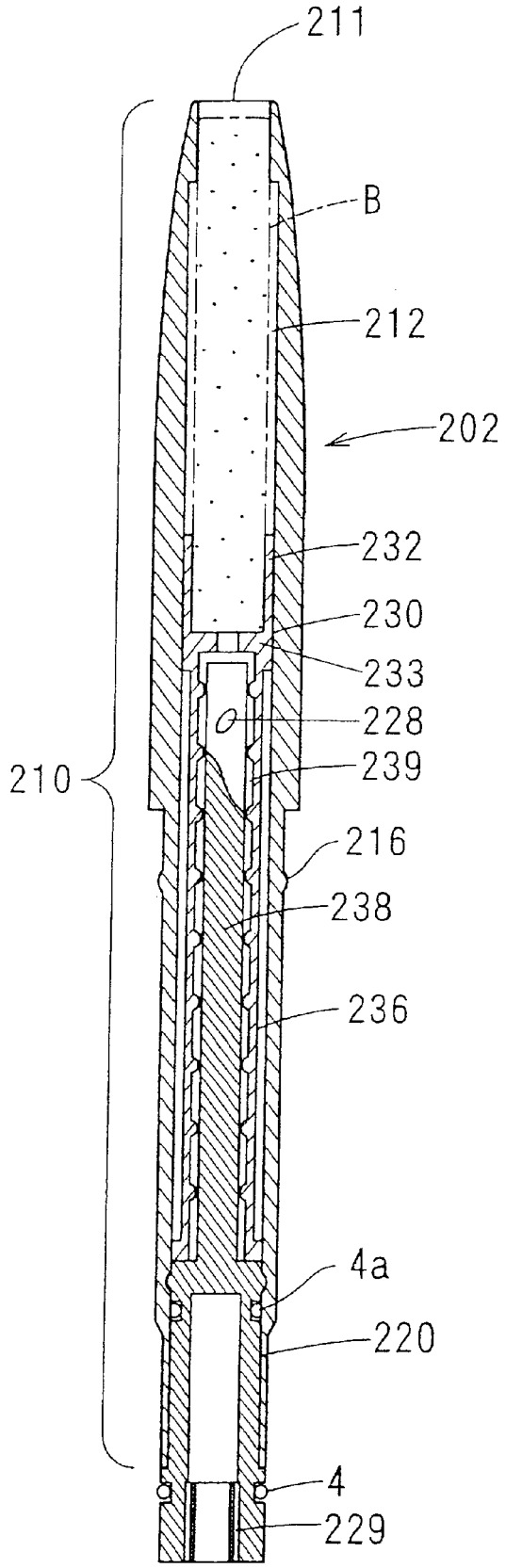
FIG. 8 is a partially longitudinal section showing a cartridge according to a third embodiment of the present invention.

FIG. 8 shows a third embodiment.

In the third embodiment, mainly the constitution of a cartridge 202 is different.

A cosmetic material retaining section 231 of a core chuck member 230 retains a stick-shaped cosmetic material B using a claw 232 and also a convex section 233 which is situated at the same line as that of the claw 232 is engaged with a slide groove 212 of a front cylinder 210 of the cartridge 202, whereby a rotation regulating mechanism is constituted.

A cylinder axis section 236 in a cylindrical shape is installed below the cosmetic material retaining section 231 of the core chuck member 230 and a spiral section 239 is formed at an inner circumference of the cylinder axis section 236.

A base cylinder 220 is inserted into a lower part of the front cylinder 210 and is rotatably connected with the front cylinder 210. Also, the O-ring 4 is wound to an outer diameter of a cylinder section which is exposed below the front cylinder 210.

And a stick-shaped section 238 is coaxially installed at an upper part of the base cylinder 220 in a standing position, and a projection 228 to be engaged with the spiral section 239 of the cylinder axis section 236 of the core chuck member 230 is arranged at a front end of the stick-shaped section 238, whereby a spiral engagement mechanism is constituted.

When the base cylinder 220 and the front cylinder 210 are rotated, the convex section 233 of the core chuck member 230 to be engaged with the slide groove 212 of the front cylinder 210 constitutes a rotation regulating mechanism. A spiral engagement mechanism is constituted by spiral engagement of the spiral section 239 of the core chuck member 230 and the projection 228 of the stick-shaped section 238 of the base cylinder 220. The core chuck member 230 begins to move in an axial direction along the front cylinder 210 and the stick-shaped cosmetic material B is caused to project through a front end opening hole 211.

Although the cartridge 202 can be installed at the container body 103 shown in FIG. 5(B) at which the cartridges 2 and 102 are installed, the cartridge 202 has constitution completely different from that of the cartridge shown in FIG. 2(A).

More specifically, when the cartridge 202 is inserted into the container body 103, by fitting in a fit-in concave section 151 a projection 216 which is arranged at a container body fit-in section of the front cylinder 210, the cartridge 202 is rotatably connected with the container body 103.

Further, the O-ring 4 wound to the base cylinder 220 of the cartridge 202 comes into contact with an O-ring contact surface 152*a* which is provided below the roulette section 153 of the container body 103, whereby the base cylinder 220 and the container body 103 synchronously rotate.

Further, a roulette section 153A which is installed at a bottom section of the container body 103 in a standing position comes into contact with a contact rib 229 which is formed at an inner circumference of a cavity section provided at a bottom section of the base cylinder 220. Thus, at the time of clutch rotation, in other word, when the container body 103 and the cartridge relatively rotate, a clutch noise similar to that of the second embodiment is generated, thereby clearly notifying a user of the uppermost limit or the lowermost limit of the core chuck member 230.

Further, similarly to the cartridge in FIG. 5(A), in the cartridge 202, the O-ring 4*a* is provided between the front cylinder 210 and the base cylinder 220, whereby the core chuck member 230 is prevented from being pushed back in a direction of retreat and the stick-shaped cosmetic material B is prevented from projecting which may occur due to the transportation and the vibrations.

The cartridge 202 retains therein the stick-shaped cosmetic material B having a thick core material. In other words, the cartridge has constitution suitable for containing a stick-shaped cosmetic material having a thick core material.

A cartridge according to the present invention does not restrict its feeding mechanism as long as the cartridge is such that a front cylinder and a base cylinder are rotatably connected, a core chuck member having a cosmetic material retaining section for retaining a stick-shaped cosmetic material is inserted therein, a feeding mechanism operates due to rotations of the front cylinder and the base cylinder, and the stick-shaped cosmetic material inserted advances and retreats along the front cylinder. An elastic body is wound to an outer circumference of a base cylinder portion of the cartridge to be housed in a container body, by synchronously rotating the base cylinder and the container body due to frictional resistance which arises between an inner circumference of the container body and the base cylinder, the feeding mechanism in the cartridge operates, the stick-shaped cosmetic material is caused to advance and retreat, and also due to a rotary load at the feeding uppermost limit or the feeding lowermost limit, the base cylinder and the container body make clutch rotations so as to protect the feeding mechanism in the cartridge and the stick-shaped cosmetic material. Further, it is also possible to generate a clutch noise at the time of the clutch rotation and notify a user of the fact.

In the present invention, the length of the base cylinder to be inserted in the container body may be equivalent to a total length or a partial length of a container body insertion section. Further, generation of a clutch noise due to contact of the base cylinder and the container body at the time of the clutch rotation may bring about at an outer circumference of the base cylinder and an inner circumference of the container body or an inner circumference of the base cylinder and an outer circumference of a spline section which is installed at a bottom section of the container body in a standing position.

As described above, the present invention provides a cartridge type stick-shaped cosmetic material feeding container in which a single container body can be applied to cartridges having different core diameters and constitution and which can provide the container body at a low price and has a function of protecting a mechanism in the cartridge and a core material.

What is claimed is:

1. A cartridge type stick-shaped cosmetic material feeding container comprising:

a cartridge having a stick-shaped cosmetic material therein; and a container body which the cartridge can freely be attached to and detached from, wherein the stick-shaped cosmetic material in the cartridge is caused to advance and retreat due to relative rotations of the container body and the cartridge attached to the container body;

the cartridge is constituted by a front cylinder and a base cylinder which is coaxially and rotatably connected with the front cylinder;

a feeding mechanism which moves in an axial direction a core chuck member for retaining the stick-shaped cosmetic material by relative rotations of the front cylinder and the base cylinder is provided in the cartridge;

an elastic body which comes into contact with an inner circumference of the container body is wound around an outer circumference of the base cylinder at a part where the base cylinder of the cartridge is attached to the container body; and due to frictional resistance of the elastic body, the container body and the base cylinder are synchronously rotated and also the container body and the base cylinder are allowed to make relative clutch rotations at a travelling limit of the core chuck member.

2. A cartridge type stick-shaped cosmetic material feeding container according to claim 1, wherein the feeding mechanism comprising:

a mutual rotation regulating mechanism constituted between the front cylinder and the core chuck member; and a spiral engagement mechanism constituted between the base cylinder and the core chuck member.

3. A cartridge type stick-shaped cosmetic material feeding container according to claim 1, wherein a first elastic body which comes into contact with an inner circumference of the front cylinder is wound to an outer circumference of a front part of the base cylinder of the cartridge and it is set such that a second elastic body, which is wound to the base cylinder and is to be in contact with an inner circumference of the container body, comes into contact with the inner circumference of the container body with frictional resistance greater than slide resistance of the first elastic body.

4. A cartridge type stick-shaped cosmetic material feeding container according to claim 1, wherein a contact rib is installed at the base cylinder, a roulette section which comes into contact with the contact rib is formed in the container body, and at the time of the clutch rotations, the contact rib and the roulette section generate a clutch noise with relative rotations.

* * * * *